US011130069B1

(12) United States Patent
Lin

(10) Patent No.: US 11,130,069 B1
(45) Date of Patent: Sep. 28, 2021

(54) WALL-CLIMBING TOY VEHICLE

(71) Applicant: Xinyan Lin, Shantou (CN)

(72) Inventor: Xinyan Lin, Shantou (CN)

( * ) Notice: Subject to any disclaimer, the term of this patent is extended or adjusted under 35 U.S.C. 154(b) by 0 days.

(21) Appl. No.: 17/155,187

(22) Filed: Jan. 22, 2021

(51) Int. Cl.

| | |
|---|---|
| ***A63H 17/26*** | (2006.01) |
| ***A63H 29/24*** | (2006.01) |
| ***A63H 29/10*** | (2006.01) |
| ***A63H 30/04*** | (2006.01) |
| ***A63H 29/22*** | (2006.01) |

(52) U.S. Cl.
CPC ..... *A63H 17/262* (2013.01); *A63H 29/10* (2013.01); *A63H 29/22* (2013.01); *A63H 29/24* (2013.01); *A63H 30/04* (2013.01)

(58) Field of Classification Search
CPC .. A63H 17/002; A63H 17/262; A63H 17/266; A63H 27/12; A63H 29/10; A63H 29/22; A63H 29/24; A63H 30/04
USPC ..... 446/237, 448, 454, 456
See application file for complete search history.

(56) References Cited

U.S. PATENT DOCUMENTS

| | | | | | |
|---|---|---|---|---|---|
| 3,926,277 | A * | 12/1975 | Shino | A47L 5/36 | 180/164 |
| 4,306,375 | A * | 12/1981 | Goldfarb | A63H 17/12 | 446/219 |
| 4,511,343 | A * | 4/1985 | Goldfarb | A63H 17/12 | 446/457 |
| 4,971,591 | A * | 11/1990 | Raviv | A63H 17/26 | 180/164 |
| 5,194,032 | A * | 3/1993 | Garfinkel | A63H 17/004 | 180/164 |
| 6,923,277 | B2 * | 8/2005 | Lin | A63H 29/22 | 180/2.2 |
| 7,980,916 | B2 * | 7/2011 | Clark, Jr. | A63H 30/04 | 446/454 |
| 8,979,609 | B2 * | 3/2015 | Clark, Jr. | A63H 30/04 | 446/454 |
| 9,675,897 | B2 * | 6/2017 | Clark, Jr. | A63H 30/04 | |
| 10,112,664 | B2 * | 10/2018 | Li | G01N 29/265 | |
| 10,220,896 | B2 * | 3/2019 | Kazakov | B62D 55/265 | |
| 10,398,995 | B2 * | 9/2019 | Clark, Jr. | A63H 30/04 | |
| 10,518,830 | B2 * | 12/2019 | Beard, III | B62D 57/024 | |
| 10,836,446 | B2 * | 11/2020 | Sekiguchi | B60D 1/155 | |
| 2009/0203292 | A1 * | 8/2009 | Clark, Jr. | A63H 17/26 | 446/454 |
| 2018/0050747 | A1 * | 2/2018 | Kazakov | B62D 57/024 | |

(Continued)

*Primary Examiner* — Joseph B Baldori
(74) *Attorney, Agent, or Firm* — Rumit Ranjit Kanakia

(57) ABSTRACT

A wall-climbing toy vehicle includes a body having a car frame structure and a base member. The car frame structure is coupled to the base member. The base member includes a horizontal part and a vertical part. The horizontal part defines a curved surface negative pressure cavity. The horizontal part includes air inlet ports and shunt grooves. The vertical part includes at least one drive mechanism installation port and a plurality of wheel installation ports. Further an air suction assembly is coupled along the air inlet ports on the horizontal part. Furthermore, at least one drive mechanism assembly is coupled to the at least one drive mechanism installation port on the vertical part. The air suction assembly and the at least one drive mechanism assembly are adapted to be driven via a power supply arrangement to enable the wall-climbing toy vehicle to drive against the vertical wall.

15 Claims, 4 Drawing Sheets

(56) References Cited

U.S. PATENT DOCUMENTS

| | | | | |
|---|---|---|---|---|
| 2018/0280824 | A1* | 10/2018 | Park | A63H 31/08 |
| 2020/0254355 | A1* | 8/2020 | Wang | A63H 29/10 |

* cited by examiner

WALL-CLIMBING TOY VEHICLE

FIELD OF THE DISCLOSURE

The present disclosure relates to a toy industry, and, more particularly, to a wall-climbing toy vehicle.

BACKGROUND OF THE DISCLOSURE

Wall-climbing toy vehicles are a new attraction among kids. Designing and manufacturing of the wall-climbing toy vehicles is a work of putting several scientific principles together. Designing and manufacturing a wall-climbing toy vehicle involves a lot of influence from science and that is why has been a field of constant innovation.

More often than not, the user specially buys wall-climbing toy vehicle, which may exhibit characteristics like good withholding of car on wall, good maneuverability on the wall and so forth.

Whenever user chooses a wall-climbing toy vehicle, he/she is left over with lot of conventional wall-climbing toy vehicle in the market. Such conventional wall-climbing toy vehicles may be effective in meeting various requirements but may not be able to address some of the specific problems. For example, there may be the conventional wall-climbing toy vehicle which may climb on the wall but fall off the wall frequently due to less suction effect or misbalancing of the conventional wall-climbing toy.

Further, there may be the conventional wall-climbing toy vehicle which may not be maneuvered on the curved section of the wall. For example, even if the conventional wall-climbing toy vehicles may be designed to have greater suction volume, such wall-climbing toy vehicle with greater suction volume may not be able to have better maneuverability due to increased suction volume as bottom cover of such conventional wall-climbing toy vehicle may include plane and smooth surfaces.

Accordingly, there exists a need to overcome shortcomings of the existing wall-climbing toy vehicle. For example, there exists a need of a wall-climbing toy vehicle which may create substantial amount of suction effect to withhold the wall during climbing the wall. Further, there is need of such wall-climbing toy vehicle which may be able to balance with greater suction volume and be maneuverable on the curved section of the wall with ease. Furthermore, there is also a need of a wall-climbing toy vehicle which may be simple in structure and involves less structural arrangements.

SUMMARY OF THE DISCLOSURE

In view of the foregoing disadvantages inherent in the prior art, the general purpose of the present disclosure is to provide a wall-climbing toy vehicle, to include all advantages of the prior art, and to overcome the drawbacks inherent in the prior art.

An object of the present disclosure is to provide a wall-climbing toy vehicle which may create substantial amount of suction effect to withhold the wall during climbing the wall.

An object of the present disclosure is to provide a wall-climbing toy vehicle which may be able to balance with greater suction volume and be maneuverable on the curved section of the wall with ease.

Another object of the present disclosure is to provide a wall-climbing toy vehicle which may be simple in structure and involves less structural arrangements.

In light of the above objects, in one aspect of the present disclosure, a wall-climbing toy vehicle is provided to be drivable over a vertical wall. The wall-climbing toy vehicle includes a body, an air suction assembly, at least one drive mechanism assembly, and the power supply arrangement.

The body includes a car frame structure and a base member. The car frame structure is coupled to the base member. The base member includes a horizontal part and a vertical part. The horizontal part is adapted to extend between opposite sides thereof to define a curved surface negative pressure cavity. When the wall-climbing toy vehicle is disposed on the vertical wall to be driven thereon, a space is formed between the curved surface negative pressure cavity and the vertical wall. The horizontal part includes air inlet ports and shunt grooves. The air inlet ports are configured along a middle portion of the curved surface negative pressure cavity, and the shunt grooves are configured along both sides of the curved surface negative pressure cavity. Further, the vertical part is adapted to extend from the opposite sides of the horizontal part. The vertical part includes at least one drive mechanism installation port and a plurality of wheel installation ports. Further, the air suction assembly is coupled along the air inlet ports on the horizontal part. The air suction assembly is configured to draw out air from the space, forming a negative pressure environment in the space such that outside atmospheric pressure is higher than the air pressure in the space to press the wall-climbing toy vehicle against the vertical wall. Furthermore, the at least one drive mechanism assembly is coupled to the at least one drive mechanism installation port on the vertical part. The at least one drive mechanism assembly is adapted to be driven to enable the wall-climbing toy vehicle to drive against the vertical wall. Moreover, the power supply arrangement is coupled on the base member to power the air suction assembly and the at least one drive mechanism assembly to drive the wall-climbing toy vehicle on the vertical wall.

In one embodiment of the present discloses, the air suction assembly includes a fan fixing frame, an air extraction motor and a wind wheel body. The fan fixing frame is coupled along the air inlet ports. The fan fixing frame includes at least one through hole, a wind wheel groove, and a through recess. Further, the air extraction motor is disposed in the fan fixing frame along the wind wheel groove such that a top portion of the air extraction motor protrudes outward from the through recess of the fan fixing fame, and a bottom portion of the air extraction motor lies in the wind wheel groove. Furthermore, the wind wheel body is disposed in the wind wheel groove and rotatably coupled to the bottom portion of the air extraction motor. The wind wheel body in cooperation with the air extraction motor draw out air from the space.

In one embodiment of the present discloses, the at least one through hole is an arc shaped, and symmetrically opened along a top portion of the fan fixing frame to enable discharge of the wind drawn by the wind wheel body.

In one embodiment of the present discloses, a center of the air inlet ports and a center of the fan fixing frame are aligned along a same vertical line, and the air inlet ports are densely distributed in a ring shape along the middle portion of the curved surface negative pressure cavity to allow the wind wheel body to draw air from the space via the air inlet ports, forming the negative pressure environment in the curved surface negative pressure cavity.

In one embodiment of the present discloses, the shunt grooves configured along both sides of the curved surface negative pressure cavity away from the air inlet ports, and are densely distributed in an array, wherein each of the shunt grooves are rectangularly shaped to enable the air to pass through the shunt grooves.

In one embodiment of the present discloses, the at least one drive mechanism assembly includes: a two-part housing structure, a drive motor, a gear set, and a drive wheel. The two-part housing structure defines an enclosure. Further, the drive motor is disposed within the enclosure. The drive motor includes an output end. Furthermore, the gear set is disposed within the enclosure. The gear set is coupled to the output end to be driven by the drive motor. The gear set includes an output shaft. Moreover, the drive wheel is disposed outside of the enclosure and coupled to the output shaft to be driven to move the wall-climbing toy vehicle.

In one embodiment of the present discloses, the two-part housing structure includes a first part housing structure and a second part housing structure. The first-and-second-part housing structures include a buckle-groove arrangement, in which buckles are configured on the first housing part and the grooves are configured on the second part housing structure.

In one embodiment of the present discloses, the output end of the drive motor includes a worm gear, and the gear set includes a pinion to be coaxially installed with the worm gear.

In one embodiment of the present discloses, the gear set includes two gears of different sizes, and a large gear of the gear set and the driving wheel are installed coaxially.

In one embodiment of the present discloses, the power supply arrangement includes a battery.

In one embodiment of the present discloses, the wall-climbing toy vehicle further includes a plurality of decorative wheels coupled to the plurality of wheel installation ports on the vertical part.

In one embodiment of the present discloses, the wall-climbing toy vehicle further includes a control board coupled to the base member to electrically control the air suction assembly, the at least one drive mechanism assembly and the power supply arrangement.

In one embodiment of the present discloses, the wall-climbing toy vehicle further includes a plurality of sealing provided along an edge of the base member to restrict the drawn air to pass from the edge of the base member.

In one embodiment of the present discloses, the body of the wall-climbing toy vehicle is made of a light-weight and rigid material, including plastic, wood and metal.

In one embodiment of the present discloses, a wall-climbing toy vehicle system is provided, wherein the wall-climbing toy vehicle may be driven by a remote control on the vertical wall.

This together with the other aspects of the present disclosure, along with the various features of novelty that characterize the present disclosure, is pointed out with particularity in the claims annexed hereto and forms a part of the present disclosure. For a better understanding of the present disclosure, its operating advantages, and the specified object attained by its uses, reference should be made to the accompanying drawings and descriptive matter in which there are illustrated exemplary embodiments of the present disclosure.

BRIEF DESCRIPTION OF THE DRAWINGS

The advantages and features of the present disclosure will become better understood with reference to the following detailed description taken in conjunction with the accompanying drawing, in which.

Like reference numerals refer to like parts throughout the description of several views of the drawing.

DETAILED DESCRIPTION OF THE DISCLOSURE

The exemplary embodiments described herein detail for illustrative purposes are subject to many variations in implementation. The present disclosure provides a wall-climbing toy vehicle. It should be emphasized, however, that the present disclosure is not limited only to what is disclosed and extends to cover various alternation to the wall-climbing toy vehicle. It is understood that various omissions and substitutions of equivalents are contemplated as circumstances may suggest or render expedient, but these are intended to cover the application or implementation without departing from the spirit or scope of the present disclosure.

The terms “a” and “an” herein do not denote a limitation of quantity, but rather denote the presence of at least one of the referenced items.

The terms “having”, “comprising”, “including”, and variations thereof signify the presence of a component.

In one aspect of the present disclosure, a wall-climbing toy vehicle is provided to be drivable over a vertical wall. The wall-climbing toy vehicle includes a body, an air suction assembly, at least one drive mechanism assembly, and the power supply arrangement. The body includes a car frame structure and a base member. The car frame structure is coupled to the base member. The base member includes a horizontal part and a vertical part. The horizontal part is adapted to extend between opposite sides thereof to define a curved surface negative pressure cavity. When the wall-climbing toy vehicle is disposed on the vertical wall to be driven thereon, a space is formed between the curved surface negative pressure cavity and the vertical wall. The horizontal part includes air inlet ports and shunt grooves. The air inlet ports are configured along a middle portion of the curved surface negative pressure cavity, and the shunt grooves are configured along both sides of the curved surface negative pressure cavity. Further, the vertical part is adapted to extend from the opposite sides of the horizontal part. The vertical part includes at least one drive mechanism installation port and a plurality of wheel installation ports. Further, the air suction assembly is coupled along the air inlet ports on the horizontal part. The air suction assembly is configured to draw out air from the space, forming a negative pressure environment in the space such that outside atmospheric pressure is higher than the air pressure in the space to press the wall-climbing toy vehicle against the vertical wall. Furthermore, the at least one drive mechanism assembly is coupled to the at least one drive mechanism installation port on the vertical part. The at least one drive mechanism assembly is adapted to be driven to enable the wall-climbing toy vehicle to drive against the vertical wall. Moreover, the power supply arrangement is coupled on the base member to power the air suction assembly and the at least one drive mechanism assembly to drive the wall-climbing toy vehicle.

Figure 1:
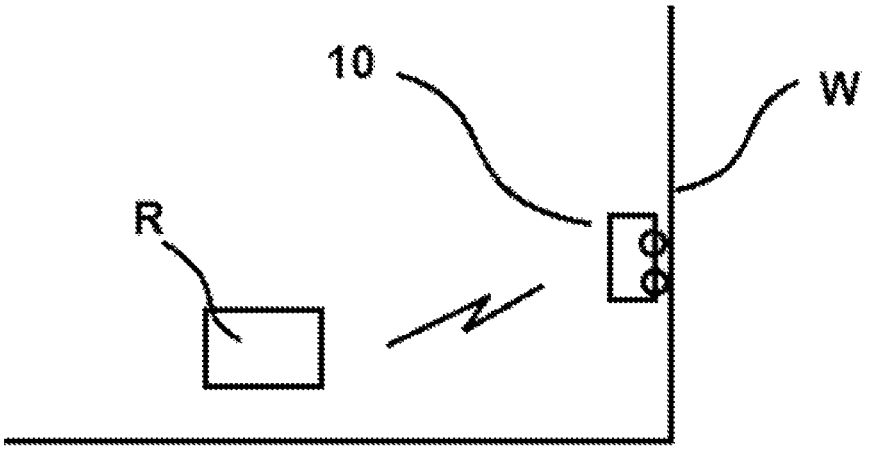
FIG. 1 illustrates an environment, wherein a wall-climbing toy vehicle is shown to climbing along a vertical wall, in accordance with an exemplary embodiment of the present disclosure.

A wall-climbing toy vehicle 10 will now be described in conjunction with FIGS. 1 to 5, in accordance with an exemplary embodiment of the present disclosure. FIG. 1 illustrates an environment, whereby a wall-climbing toy vehicle 10 is shown to climbing along a vertical wall 'W'. As seen in FIG. 1, a wall-climbing toy vehicle 10 is provided. The wall-climbing toy vehicle 10 may be capable of climbing along a vertical wall 'W'. The wall-climbing toy vehicle 1000 may be controllable by a remote control 'R' over the vertical wall 'W'.

Figure 2:
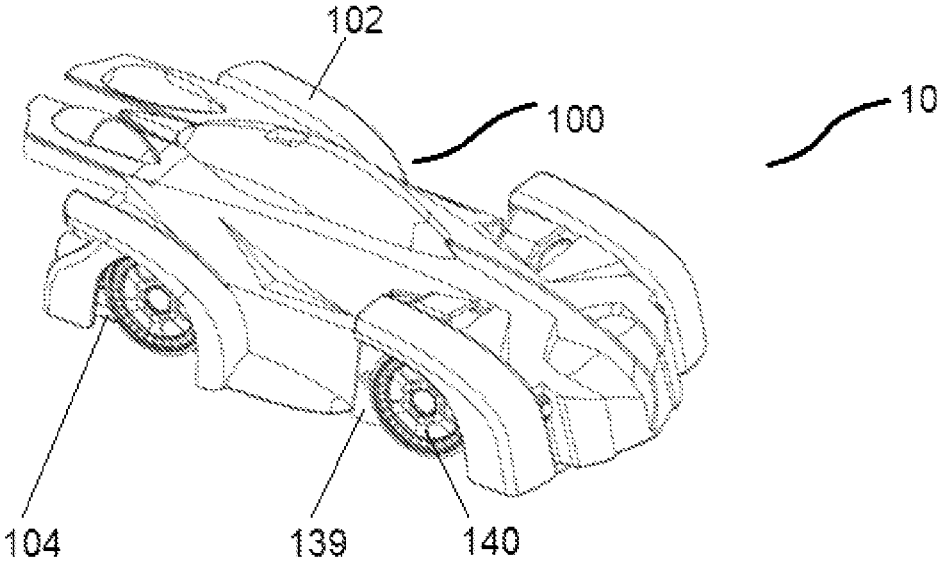
FIG. 2 illustrates a perspective view of a wall-climbing toy vehicle, in accordance with an exemplary embodiment of the present disclosure.
Figure 3A:
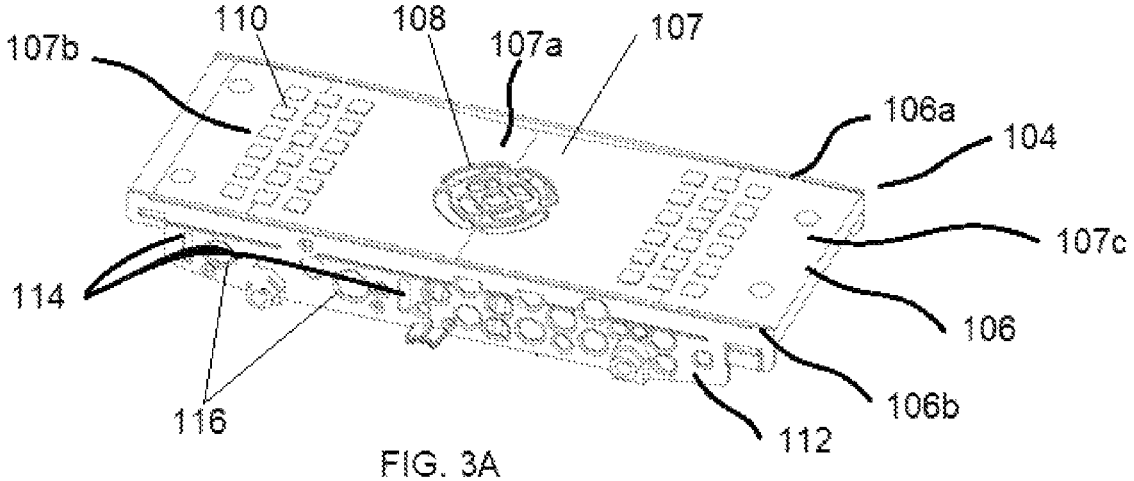
FIG. 3A illustrates a bottom view of a base member of a wall-climbing toy vehicle, in accordance with an exemplary embodiment of the present disclosure.
Figure 3B:
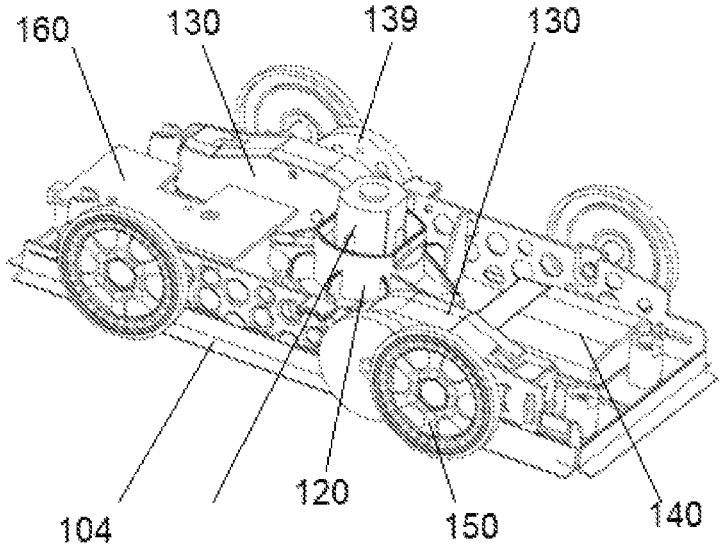
FIG. 3B illustrates a top view a base member along with various components installed thereon, in accordance with an exemplary embodiment of the present disclosure.
Figure 4A:
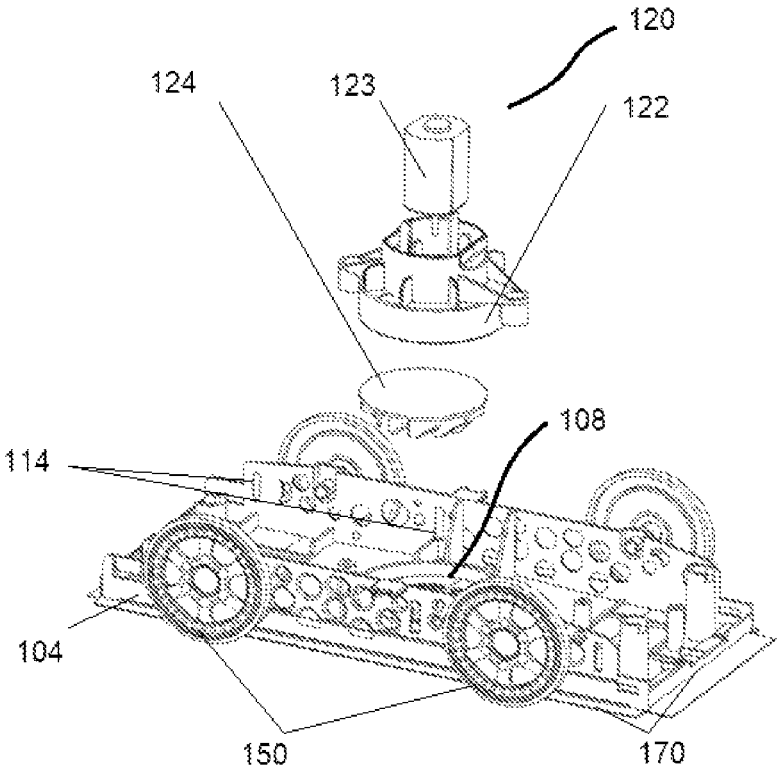
FIG. 4A illustrates an exploded view of an air suction assembly along with a base member of wall-climbing toy vehicle, in accordance with an exemplary embodiment of the present disclosure.
Figure 4B:
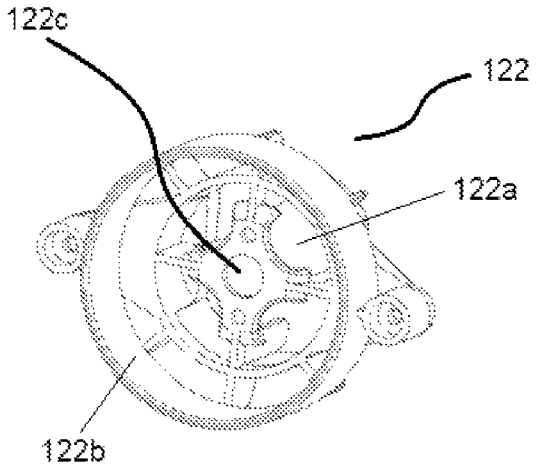
FIG. 4B illustrates a perspective view of a fan fixing frame of the air suction assembly, in accordance with an exemplary embodiment of the present disclosure.
Figure 5:
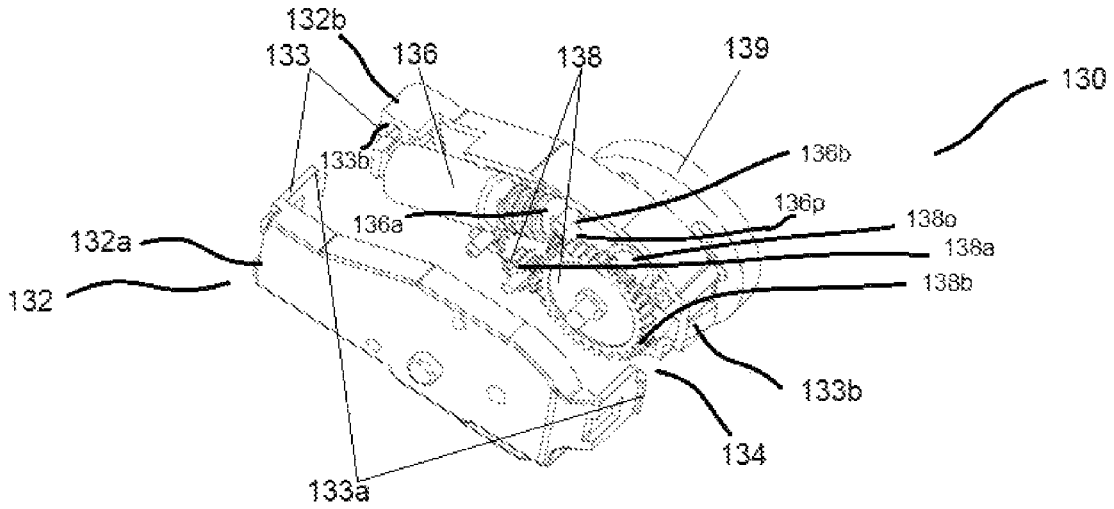
FIG. 5 illustrates a drive mechanism assembly of a wall-climbing toy vehicle, in accordance with an exemplary embodiment of the present disclosure.

Further, FIGS. 2 to 5 illustrate various view of the wall-climbing toy vehicle 10 along with various components. FIG. 2 illustrates a perspective view of the wall-climbing toy vehicle 10. FIG. 3A illustrates a bottom view of a base member 104 of a wall-climbing toy vehicle 10. FIG. 3B illustrates a top view a base member 104 along with various components installed thereon. FIG. 4A illustrates an exploded view of an air suction assembly 120 along with a base member 104 of wall-climbing toy vehicle 10. FIG. 4B illustrates a perspective view of a fan fixing frame 122 of the air suction assembly 120. FIG. 5 illustrates a drive mechanism assembly 130 of a wall-climbing toy vehicle 10.

As seen in FIGS. 2 to 5, the wall-climbing toy vehicle 10 includes a body 100, an air suction assembly 120, at least one drive mechanism assembly 130, and the power supply arrangement 140.

As shown in FIGS. 2, 3A and 3B, the body 100 may include a car frame structure 102 and a base member 104. In one embodiment of the present discloses, the body 100 of the wall-climbing toy vehicle 10 may be made of a light-weight and rigid material, including plastic, wood and metal.

The car frame structure 102 may be coupled to the base member 104. The base member 104 may include a horizontal part 106 and a vertical part 112. The horizontal part 106 may be adapted to extend between opposite sides 106*a*, 106*b* thereof to define a curved surface negative pressure cavity 107. When the wall-climbing toy vehicle 10 is disposed on the vertical wall 'W' to be driven thereon, a space 'S' is formed between the curved surface negative pressure cavity 107 and the vertical wall 'W'. The horizontal part 106 may include air inlet ports 108 and shunt grooves 110. The air inlet ports 108 may be configured along a middle portion 107*a* of the curved surface negative pressure cavity 107, and the shunt grooves 110 may be configured along both sides 107*b*, 107*c* of the curved surface negative pressure cavity 107. Further, the vertical part 112 may be adapted to extend from the opposite sides 106*a*, 106*b* of the horizontal part 106. The vertical part 112 may include at least one drive mechanism installation port 114 and a plurality of wheel installation ports 116, as will be described herein later.

Further, as shown in FIGS. 4A and 4B and described herein in conjunction with FIGS. 3A and 3B, the air suction assembly 120 may be coupled along the air inlet ports 108 on the horizontal part 106. The air suction assembly 120 may be configured to draw out air from the space 'S', forming a negative pressure environment in the space 'S' such that outside atmospheric pressure is higher than the air pressure in the space 'S' to press the wall-climbing toy vehicle 10 against the vertical wall 'W'.

In one embodiment of the present discloses, the air suction assembly 120 may include a fan fixing frame 122, an air extraction motor 123 and a wind wheel body 124. The fan fixing frame 122 may be coupled along the air inlet ports 108 via suitable coupling device, such as screws or bolts. The fan fixing frame 122 may include at least one through hole 122*a*, a wind wheel groove 122*b*, and a through recess 122*c*. Further, the air extraction motor 123 may be disposed in the fan fixing frame 122 along the wind wheel groove 122*b* such that a top portion of the air extraction motor 123 protrudes outward from the through recess 122*c* of the fan fixing fame 122, and a bottom portion of the air extraction motor 123 lies in the wind wheel groove 122*b*. Furthermore, the wind wheel body 124 may be disposed in the wind wheel groove 122*b* and rotatably coupled to the bottom portion of the air extraction motor 123. The wind wheel body 124 in cooperation with the air extraction motor 123 draw out air from the space 'S'.

In one embodiment of the present discloses, the at least one through hole 122*b* is an arc shaped, and symmetrically opened along a top portion of the fan fixing frame 122 to enable discharge of the wind drawn by the wind wheel body 124.

In one embodiment of the present discloses, a center of the air inlet ports 108 and a center of the fan fixing frame 122 are aligned along a same vertical line, and the air inlet ports 108 are densely distributed in a ring shape along the middle portion 107*a* of the curved surface negative pressure cavity 107 to allow the wind wheel body 124 to draw air from the space 'S' via the air inlet ports 108, forming the negative pressure environment in the curved surface negative pressure cavity 107.

In one embodiment of the present discloses, the shunt grooves 110 configured along both sides 107*b*, 107*c* of the curved surface negative pressure cavity 107 away from the air inlet ports 108, and are densely distributed in an array, wherein each of the shunt grooves 110 may be rectangularly shaped to enable the air to pass through the shunt grooves 110.

Referring now to FIG. 5, the at least one drive mechanism assembly 130 will now be described in conjunction with FIGS. 2 to 4B. The at least one drive mechanism assembly 130 may be coupled to the at least one drive mechanism installation port 114 on the vertical part 112, as shown in FIGS. 3A and 4A. Further, as shown in FIG. 3B, in an exemplary embodiment, two drive mechanism assembly 130 are incorporated on the base member 104. The drive mechanism assemblies 130 may be adapted to be driven to enable the wall-climbing toy vehicle 10 to drive against the vertical wall 'W'.

In one embodiment of the present discloses, the drive mechanism assemblies 130 may include a two-part housing structure 132, a drive motor 136, a gear set 138, and a drive wheel 139. The two-part housing structure 132 may define an enclosure 134. Further, the drive motor 136 may be disposed within the enclosure 134. The drive motor 136 may include an output end 136*a*. Furthermore, the gear set 138 may be disposed within the enclosure 134. The gear set 138 may be coupled to the output end 136*a* to be driven by the drive motor 136. The gear set 138 may include an output shaft 1380. Moreover, the drive wheel 139 may be disposed outside of the enclosure 134 and coupled to the output shaft 138*o* to be driven to move the wall-climbing toy vehicle 10.

Further, in one embodiment of the present discloses, the two-part housing structure 132 may include a first part housing structure 132*a* and a second part housing structure 132*b*. The first-and-second-part housing structures 132*a*, 132*b* may include a buckle-groove arrangement 133, in which buckles 133*a* are configured on the first housing part 132*a* and the grooves are configured on the second part housing structure 132*b* to snap close the first part housing structure 132*a* and the second part housing structure 132*b* together.

Furthermore, in one embodiment of the present discloses, the output end 136*a* of the drive motor 136 may include a worm gear 136*b*, and the gear set 138 includes a pinion 138*p* to be coaxially installed with the worm gear 136*b* to transfer the motion of the drive motor 136 to the gear set 138. Moreover, in one embodiment of the present discloses, the gear set 138 may include two gears 138*a*, 138*b* of different sizes, and a large gear 138*b* of the gear set 138 and the driving wheel 139 are installed coaxially to drive the drive wheel 139.

The wall-climbing toy vehicle 10, as mentioned above, includes the power supply arrangement 140 coupled on the base member 104 to power the air suction assembly 120 and the at least one drive mechanism assembly 130 to drive the wall-climbing toy vehicle 10 on the wall 'W'. In one example embodiment, the power supply arrangement 140 may include a battery (not shown) enclosed in a casing of the power supply arrangement 140. Without departing from the scope of the present disclose, the power supply arrangement 140 may include electrical supply source to power the air suction assembly 120 and the at least one drive mechanism assembly 130 to drive the wall-climbing toy vehicle 10 on the wall 'W'.

The wall-climbing toy vehicle 10 may include a control board 160 coupled to the base member 104 to electrically control the air suction assembly 120, the at least one drive mechanism assembly 130 and the power supply arrangement 140 via the power supply arrangement 140. The control board 160 may include a switch electrically coupled to the power supply arrangement 140 to switch-on and switch-off the power supply arrangement 140 to supply power or disconnect power to the air suction assembly 120, the at least one drive mechanism assembly 130.

In one embodiment of the present discloses, the wall-climbing toy vehicle 10 may include a plurality of decorative wheels 150 coupled to the plurality of wheel installation ports 116 on the vertical part 112. The plurality of decorative wheels 150 may provide an aesthetic look of over all the wall-climbing toy vehicle 10 along with provide support to the wall-climbing toy vehicle 10 while the wall-climbing toy vehicle 10 is been driven on the vertical wall or on the ground.

In one embodiment of the present discloses, the wall-climbing toy vehicle 10 may further include a plurality of sealing 170 provided along an edge of the base member 104 to restrict the drawn air to pass from the edge of the base member 104.

In operation, when using the wall-climbing toy vehicle 10, first turn on the switch connected to power supply arrangement 140, the battery in the power supply arrangement 140 supplies power to the air suction assembly 120 and to the at least one drive mechanism assembly 130. The air suction assembly 120 when activated draws out air from the space 'S', forming the negative pressure environment in the space 'S' such that outside atmospheric pressure is higher than the air pressure in the space 'S' to press the wall-climbing toy vehicle 10 against the vertical wall 'W'. Further, the at least one drive mechanism assembly 130 enables the wall-climbing toy vehicle 10 to drive against the vertical wall 'W'.

The present disclosure is advantageous in providing a wall-climbing toy vehicle which may create substantial amount of suction effect to withhold the wall during climbing the wall. The present disclosure is advantageous in providing a wall-climbing toy vehicle which may be able to balance with greater suction volume and be maneuverable on the curved section of the wall with ease. The present disclosure is advantageous in providing a wall-climbing toy vehicle which is simple in structure and involves less structural arrangements.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, and to thereby enable others skilled in the art to best utilize the present disclosure and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the spirit or scope of the present disclosure.

What is claimed is:

1. A wall-climbing toy vehicle drivable over a vertical wall, the wall-climbing toy vehicle, comprising:

a body having a car frame structure and a base member, the car frame structure coupled to the base member, the base member having:

a horizontal part extending between opposite sides thereof to define a curved surface profile along a middle portion of the horizontal part, a curved surface negative pressure cavity formed on the curved surface profile along the middle portion, wherein when the wall-climbing toy vehicle is disposed on the vertical wall to be driven thereon, the horizontal part from a side having the curved surface profile faces the vertical wall to define a space formed between the curved surface negative pressure cavity and the vertical wall, the horizontal part having:

air inlet ports configured along the middle portion of the curved surface negative pressure cavity, and shunt grooves configured along both sides of the curved surface negative pressure cavity, and a vertical part extending from the opposite sides of the horizontal part, the vertical part having at least one drive mechanism installation port, and a plurality of wheel installation ports;

an air suction assembly having a wind wheel body, the air suction assembly coupled along the air inlet ports on the horizontal part within the car frame structure such that the wind wheel body along with the curved surface profile of horizontal part face the vertical wall when the wall-climbing toy vehicle is disposed on the vertical wall to be driven thereon, the air suction assembly is configured to draw out air from the space, forming a negative pressure environment in the space such that outside atmospheric pressure is higher than the air pressure in the space to press the wall-climbing toy vehicle against the vertical wall;

at least one drive mechanism assembly coupled to the at least one drive mechanism installation port on the vertical part, the at least one drive mechanism assembly is adapted to be driven to enable the wall-climbing toy vehicle to drive against the vertical wall; and a power supply arrangement coupled on the base member to power the air suction assembly and the at least one drive mechanism assembly to drive the wall-climbing toy vehicle.

2. The wall-climbing toy vehicle of claim 1, wherein the air suction assembly comprises:

a fan fixing frame coupled along the air inlet ports, the fan fixing frame having at least one through hole, a wind wheel groove, and a through recess;

an air extraction motor disposed in the fan fixing frame along the wind wheel groove such that a top portion of the air extraction motor protrudes outward from the through recess of the fan fixing fame, and a bottom portion of the air extraction motor lies in the wind wheel groove; and the wind wheel body disposed in the wind wheel groove and rotatably coupled to the bottom portion of the air extraction motor, wherein the wind wheel body in cooperation with the air extraction motor draw out air from the space.

3. The wall-climbing toy vehicle of claim 2, wherein the at least one through hole is an arc shaped, and symmetrically opened along a top portion of the fan fixing frame to enable discharge of the wind drawn by the wind wheel body.

4. The wall-climbing toy vehicle of claim 2, wherein a center of the air inlet ports and a center of the fan fixing frame are aligned along a same vertical line, and the air inlet ports are densely distributed in a ring shape along the middle portion of the curved surface negative pressure cavity to allow the wind wheel body to draw air from the space via the air inlet ports, forming the negative pressure environment in the curved surface negative pressure cavity.

5. The wall-climbing toy vehicle of claim 1, wherein the shunt grooves configured along both sides of the curved surface negative pressure cavity away from the air inlet ports, and are densely distributed in an array, wherein each of the shunt grooves are rectangularly shaped to enable the air to pass through the shunt grooves.

6. The wall-climbing toy vehicle of claim 1, wherein the at least one drive mechanism assembly comprises:

a two-part housing structure defines an enclosure;

a drive motor disposed within the enclosure; the drive motor includes an output end;

a gear set disposed within the enclosure, the gear set is coupled to the output end to be driven by the drive motor, the gear set includes an output shaft; and a drive wheel disposed outside of the enclosure and coupled to the output shaft to be driven to move the wall-climbing toy vehicle.

7. The wall-climbing toy vehicle of claim 6, wherein the two-part housing structure having a first part housing structure and a second part housing structure, both of the first and second part housing structures are separate parts from that of the body, or the car frame structure or the base member, wherein the first-and-second-part housing structures includes a buckle-groove arrangement, in which buckles are configured on the first housing part and the grooves are configured on the second part housing structure.

8. The wall-climbing toy vehicle of claim 6, wherein the output end of the drive motor comprises a worm gear; and the gear set comprises a pinion to be coaxially installed with the worm gear.

9. The wall-climbing toy vehicle of claim 6, wherein the gear set comprises two gears of different sizes, and a large gear of the gear set and the driving wheel are installed coaxially.

10. The wall-climbing toy vehicle of claim 1, wherein the power supply arrangement comprises a battery.

11. The wall-climbing toy vehicle of claim 1 further comprising a plurality of decorative wheels coupled to the plurality of wheel installation ports on the vertical part.

12. The wall-climbing toy vehicle of claim 1 further comprising a plurality of sealing elements provided along an edge of the base member to restrict the drawn air to pass from the edge of the base member.

13. The wall-climbing toy vehicle of claim 1, wherein the body is of a light-weight and rigid material of one of a plastic, a wood and a metal.

14. The wall-climbing toy vehicle of claim 1 further comprising a control board coupled to the base member to electrically control the air suction assembly, the at least one drive mechanism assembly and the power supply arrangement.

15. A wall-climbing toy vehicle system drivable over a vertical wall, the wall-climbing toy vehicle system, comprising:

a wall-climbing toy vehicle having:

a body having a car frame structure and a base member, the car frame structure coupled to the base member, the base member having:

a horizontal part extending between opposite sides thereof to define a curved surface profile along a middle portion of the horizontal part, a curved surface negative pressure cavity formed on the curved surface profile along the middle portion, wherein when the wall-climbing toy vehicle is disposed on the vertical wall to be driven thereon, the horizontal part from a side having the curved surface profile faces the vertical wall to define a space formed between the curved surface negative pressure cavity and the vertical wall, the horizontal part having:

air inlet ports configured along the portion of the curved surface negative pressure cavity, and shunt grooves configured along both sides of the curved surface negative pressure cavity, and a vertical part extending from the opposite sides of the horizontal part, the vertical part having at least one drive mechanism installation port, and a plurality of wheel installation ports, an air suction assembly having a wind wheel body, the air suction assembly coupled along the air inlet ports on the horizontal part within the car frame structure such that the wind wheel body along with the curved surface profile of horizontal part face the vertical wall when the wall-climbing toy vehicle is disposed on the vertical wall to be driven thereon, the air suction assembly is configured to draw out air from the space, forming a negative pressure environment in the space such that outside atmospheric pressure is higher than the air pressure in the space to press the wall-climbing toy vehicle against the vertical wall, at least one drive mechanism assembly coupled to the at least one drive mechanism installation port on the vertical part, the at least one drive mechanism assembly is adapted to be driven to enable the wall-climbing toy vehicle to drive against the vertical wall, and a power supply arrangement coupled on the base member to power the air suction assembly and the at least one drive mechanism assembly to drive the wall-climbing toy vehicle, and a control board coupled to the base member to electrically control the air suction assembly, the at least one drive mechanism assembly and the power supply arrangement; and a remote control coupled to the control board to remotely drive the wall-climbing toy vehicle over the vertical wall.

* * * * *